US011051591B2

(12) United States Patent
Jackson

(10) Patent No.: US 11,051,591 B2
(45) Date of Patent: Jul. 6, 2021

(54) JEWELRY WITH CREMAINS AND PRINT IMAGE AND METHOD OF FORMING THE SAME

(71) Applicant: Vital Marketing, Incorporated, Tupelo, MS (US)

(72) Inventor: Terry Jackson, Tupelo, MS (US)

(73) Assignee: VITAL MARKETING, INCORPORATED, Tupelo, MS (US)

( * ) Notice: Subject to any disclaimer, the term of this patent is extended or adjusted under 35 U.S.C. 154(b) by 187 days.

(21) Appl. No.: 16/440,437

(22) Filed: Jun. 13, 2019

(65) Prior Publication Data

US 2020/0390201 A1 Dec. 17, 2020

(51) Int. Cl.

| | |
|---|---|
| ***A44C 5/00*** | (2006.01) |
| ***A44C 9/00*** | (2006.01) |
| ***A44C 27/00*** | (2006.01) |
| ***E04H 13/00*** | (2006.01) |
| ***A61G 17/007*** | (2006.01) |

(52) U.S. Cl.

CPC ..... *A44C 5/0015* (2013.01); *A44C 9/0069* (2013.01); *A44C 27/005* (2013.01); *A61G 17/0166* (2017.05); *E04H 13/008* (2013.01)

(58) Field of Classification Search

CPC .. A61G 17/08; A61G 17/0166; A44C 9/0069; A44C 27/005; A44C 5/0015; A44C 25/002; A44C 15/004; E04H 13/008

USPC ..... 27/1; 428/542.2, 542.4; 63/1.11, 1.14, 3, 63/18, 19

See application file for complete search history.

(56) References Cited

U.S. PATENT DOCUMENTS 5,208,957 A * 5/1993 Hereford ..... A44C 25/00 206/37
5,755,116 A * 5/1998 Sparacino ..... A44C 5/003 63/1.14
5,950,287 A * 9/1999 Cacciatore ..... A61G 17/08 27/1
5,987,720 A * 11/1999 Yamamoto ..... A61G 17/0136 27/35
6,382,111 B1 * 5/2002 Hojaji ..... C04B 33/24 110/341

(Continued)

FOREIGN PATENT DOCUMENTS

JP 2006255367 A * 9/2006

OTHER PUBLICATIONS

Memorials.com, Fingerprint Jewelry & Thumbies, https://www.memorials.com/fingerprint-jewelry-thumbies.php?thisPage=2, page visited Apr. 22, 2019.

(Continued)

*Primary Examiner* — William L Miller

(74) *Attorney, Agent, or Firm* — Standley Law Group LLP

(57) ABSTRACT

An item of jewelry includes a first and second glass component. The first component includes a base layer with cremains deposited on a front surface. The second component is the same size and shape as the first component so that its outer edges align with those of the first component. The second component includes an image of a print placed on a substrate. The first component is placed on, and annealed to, the second component such that the cremains are sandwiched between the base layer and the substrate to form a durable image of the print on glass.

20 Claims, 7 Drawing Sheets

(56) References Cited

U.S. PATENT DOCUMENTS 7,861,385 B1 * 1/2011 Meyer ..... A61G 17/0136 27/1
8,281,465 B1 * 10/2012 Miraldi ..... A61G 17/0136 27/1
9,334,669 B1 * 5/2016 Byndon ..... E04H 13/008
10,517,360 B1 * 12/2019 Bethany ..... A61G 17/08
2005/0071964 A1 * 4/2005 Vogel ..... B09B 3/005 27/1
2006/0105308 A1 * 5/2006 Fraser ..... A44C 23/00 434/246
2006/0261512 A1 * 11/2006 Weisbrot ..... A61G 17/08 264/234
2008/0209945 A1 * 9/2008 Blevins ..... C03B 23/203 65/42
2009/0266108 A1 * 10/2009 Balme ..... A61G 17/007 63/1.11
2010/0199476 A1 * 8/2010 Cummings ..... A61G 17/08 27/1
2010/0275649 A1 * 11/2010 Eggleston ..... A44C 25/002 63/1.14
2015/0013382 A1 * 1/2015 Murphy ..... B29C 37/0028 63/15
2015/0209211 A1 * 7/2015 Savage ..... A61G 17/08 27/1
2016/0324278 A1 * 11/2016 Gobbato ..... A44C 25/002
2017/0254108 A1 * 9/2017 Armstrong ..... C04B 28/14
2018/0070686 A1 * 3/2018 de Cezaro ..... A44C 25/002
2019/0160710 A1 * 5/2019 Allison ..... B29C 33/3857
2020/0093673 A1 * 3/2020 Hatry ..... A61G 17/08
2020/0383861 A1 * 12/2020 Starts ..... B44C 3/06
2021/0027406 A1 * 1/2021 Yakovleva ..... G06Q 10/0832

OTHER PUBLICATIONS

Fused Hope, https://www.facebook.com/pages/category/Jewelry-Watches/Fused-Hope-180074732977/, page visited Apr. 30, 2019.
AliExpress, https://www.aliexpress.com/item/32588534960.html, page visited Apr. 30, 2019.
Fused Hope, Pinterest, https://www.pinterest.com/fusedhope/, page visited Apr. 30, 2019.
Dena Barnes, Pinterest, https://www.pinterest.com/pin/445152744387458913/?lp=true, page visited Apr. 30, 2019.

* cited by examiner

56

JEWELRY WITH CREMAINS AND PRINT IMAGE AND METHOD OF FORMING THE SAME

CROSS-REFERENCE TO RELATED APPLICATIONS

This application makes no priority claim.

TECHNICAL FIELD

Exemplary embodiments relate generally to jewelry having cremains and an image of a print as well as a method for forming the same, preferably, out of glass.

BACKGROUND AND SUMMARY OF THE INVENTION

A variety of mementos have been used over the years to honor and remember loved ones who have passed away. Grave stones have long been used to mark the final resting place of a loved one. Plaques and other markers have long been used to commemorate and honor loved ones. When a loved one is cremated, a variety of options exist for holding the remains. Urns are well known pieces for holding cremains. Other options include incorporating some of the cremains within a variety of jewelry pieces. Separately, jewelry exists which incorporates the fingerprints of loved ones—whether living or deceased. However, what is needed is jewelry which incorporates both cremains as well as an image of a print of a loved one, where the jewelry is preferably comprised of glass.

Jewelry having cremains and an image of a print as well as a method for forming the same, preferably out of glass, is provided. An image of the print, such as but not limited to a fingerprint, may be obtained from the deceased. The image may be put on glass using ceramic materials that make the image extremely durable. Cremains from the deceased may be obtained, prepared, and added to a surface of a shaped base layer. The completed component with the print image may be added to the base layer such that the cremains are sandwiched therebetween. The completed central piece may be fired in a kiln to adhere the components together. Additional elements, such as but not limited to, a bale and necklace may be added.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
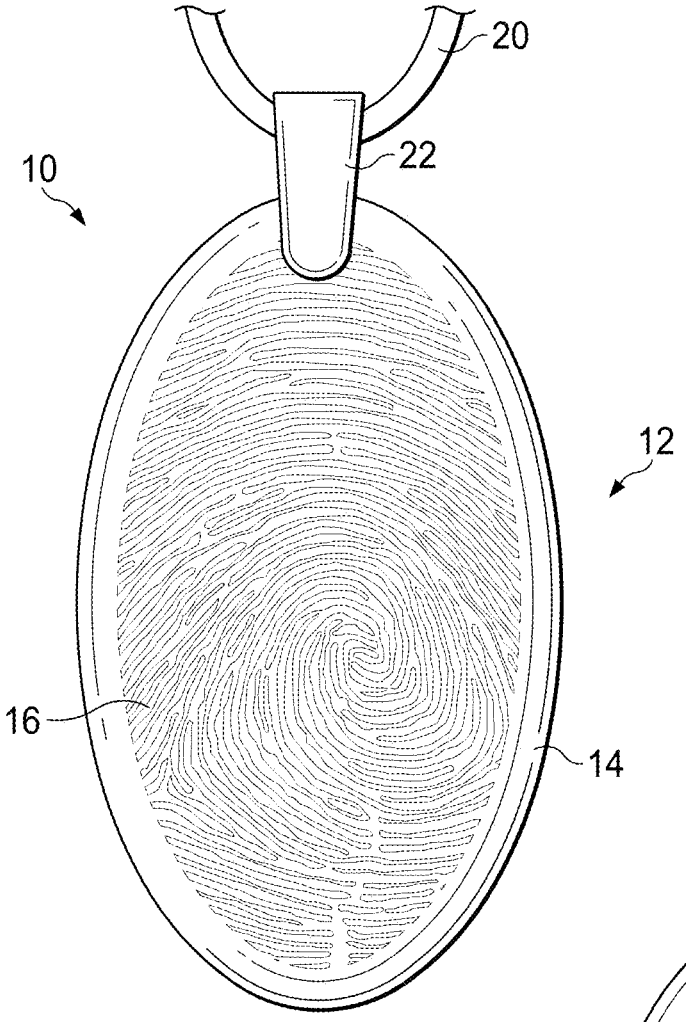
FIG. 1 is a front view of an exemplary piece of jewelry.
Figure 2:
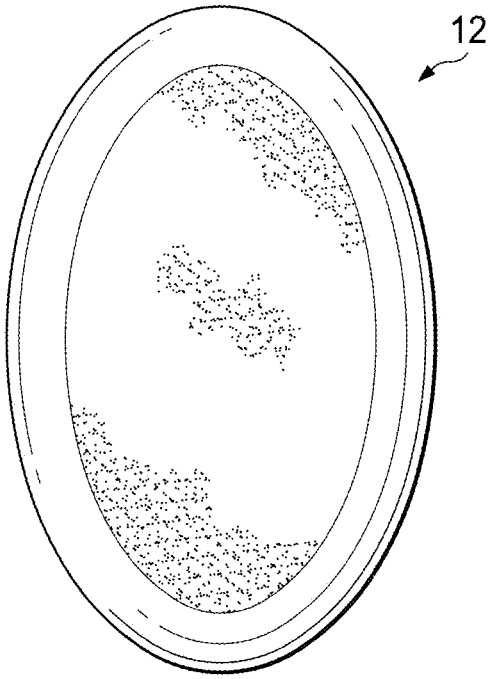
FIG. 2 is a rear view of a central piece of the jewelry of FIG. 1.
Figure 3:
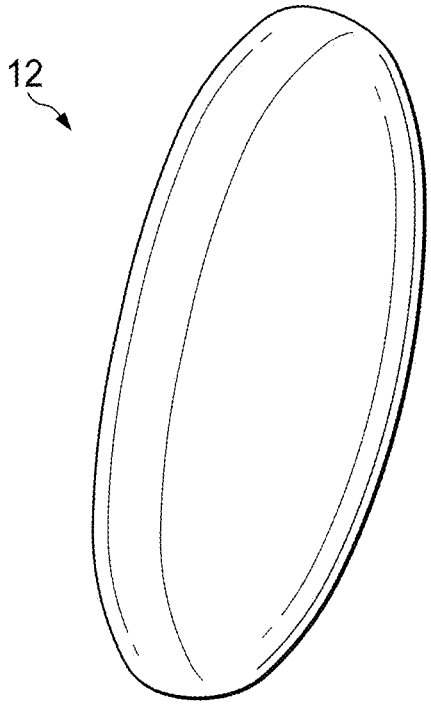
FIG. 3 is a top view of the central piece of the jewelry of FIG. 1.
Figure 4:
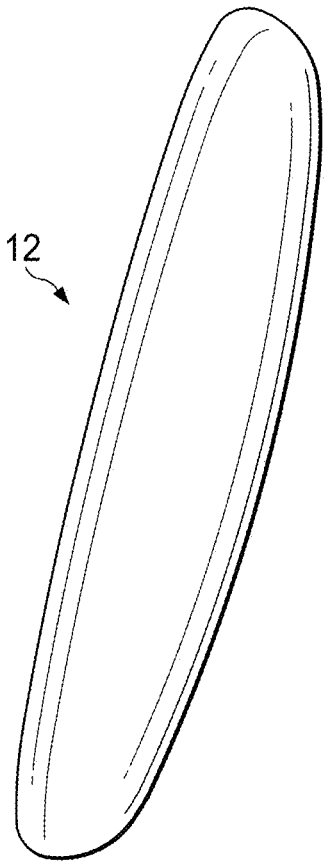
FIG. 4 is a left side view of the central piece of the jewelry of FIG. 1.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 4 illustrate various views of an exemplary piece of jewelry 10. The jewelry 10 may comprise one or more central pieces 12 as well as a number of additional elements. Such additional elements may include, for example without limitation, a bale 22, a necklace 20, a bracelet, a ring mount, an earring base, a hair clip, some combination thereof, or the like. The central piece 12 may be incorporated into any kind of jewelry piece including, but not limited to, a necklace, a bracelet, a ring, an earring, a piercing, an ankle, a broach, a hair clip, some combination thereof, or the like, using any number and type of additional elements. In exemplary embodiments, the central piece 12 may be formed into an oval shaped pendant, though any shape and size central piece 12 is contemplated. The central piece 12 may be attached to one or more additional elements, such as but not limited to the bale 22. The bale 22 may likewise be configured to accommodate one or more additional elements, such as but not limited to, the necklace 20.

It is notable that the central piece 12 may be symmetrical in shape across one or more centerlines. The additional elements may be symmetrical in shape across one or more centerlines. In exemplary embodiments, without limitation, the central piece 12 is symmetrical in shape across a vertically extending centerline and a horizontally extending centerline such that the left side view and right side view of the central piece 12, as well as the top view and bottom view, may be substantially identical. However, the elements of such views may vary in color, pattern, image, and the like.

Figure 5B:
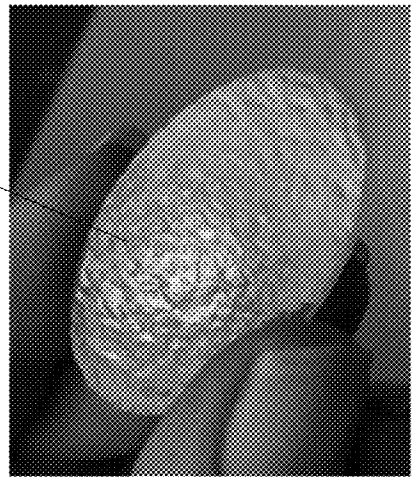
FIG. 5B is a rear view of the first component of FIG. 5A.
Figure 5C:
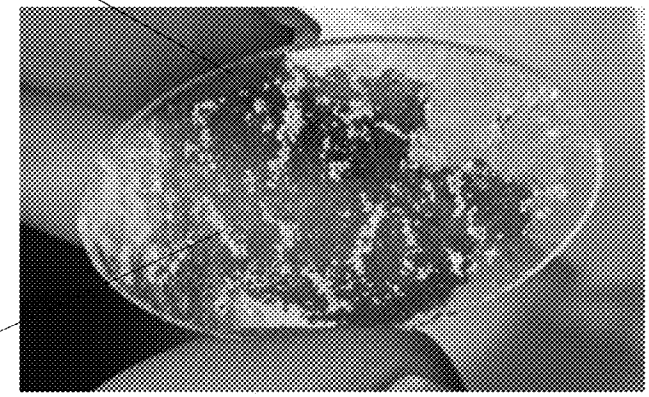
FIG. 5C is a front view of the first component of FIG. 5A with cremains added.
Figure 5A:
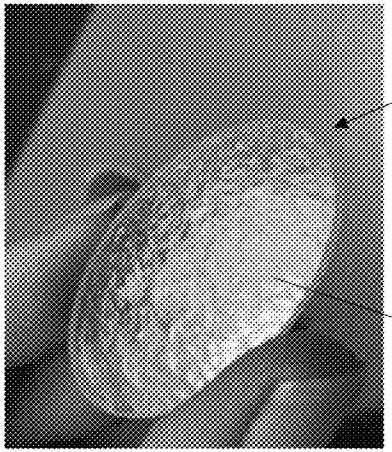
FIG. 5A is a front view of a first component of the central piece of the jewelry of FIG. 1.

The central piece 12 may comprise a first component 14 and a second component 16. FIG. 5A through FIG. 5C illustrate various views of the first component 14. The first component 14 may comprise a base layer 11. In exemplary embodiments, the base layer 11 may be substantially oval shaped, though any size or shape is contemplated. The base layer 11 may be comprised of a transparent or translucent material, though such is not required. For example, without limitation, the base layer 11 may be comprised of glass or a polymer, though any material is contemplated. An iridescent layer or film 13 may be located on a rear surface of the base layer 11, as shown in FIG. 5B, though such is not required. Cremains 15 may be deposited on a front surface of the base layer 11 as shown in FIG. 5C and further discussed herein. The cremains 15 may be human cremains, pet cremains, or the like.

Figure 6:
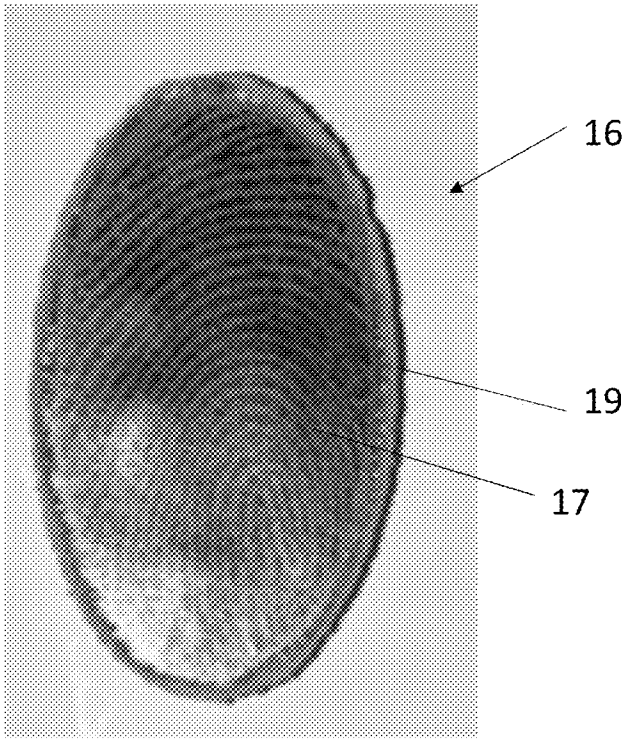
FIG. 6 is a top view of a second component of the central piece of the jewelry of FIG. 1.

FIG. 6 illustrates a top view of the second component 16. The second component 16 may comprise an image 17 and a substrate 19. In exemplary embodiments, the image 17 comprises an image of a print. The print may be a fingerprint, toe print, palm print, foot print, paw print, or the like. In exemplary embodiments, the print is of the person or animal whose cremains 15 as located on the base layer 11, though such is not required.

In exemplary embodiments, the image 17 and the substrate 19 may be substantially oval shaped, though any size or shape is contemplated. The image 17 may be comprised of a transparent or translucent material. In exemplary embodiments, the image 17 is comprised of ceramic pigment, which may comprise colored pigments and glass, though such is not required. The ceramic pigments may comprise, additionally or alternatively, silica, alumina, and flux. The substrate 19 may comprise any number of decorative elements including, but not limited to, colored pigments, patterns, some combination thereof, or the like. The substrate 19 may be comprised of glass or a polymer, though any material is contemplated. In exemplary embodiments, the image 17 and the substrate 19 may be substantially the same size and shape.

Figure 7:
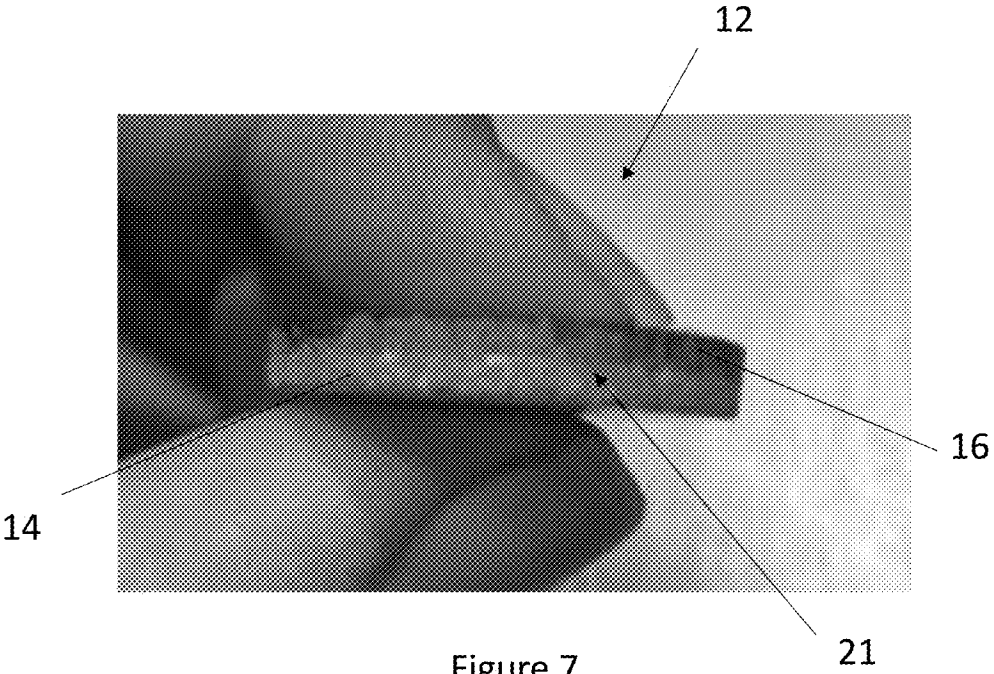
FIG. 7 is a side view of the central piece of the jewelry of FIG. 1.

FIG. 7 is a side view of a partially formed central piece 12. As further discussed herein, the first and the second components 14 and 16 may be attached to one another. For example, without limitation, the second component 16 may be secured atop the first component 14. In exemplary embodiments, the first component 14 is attached to the second component 16 such that the iridescent layer 13, if utilized, faces outwardly to the rear and the cremains 15 are placed against the second component 16. The second component 16 may be oriented such that the image 17 faces outwardly to the front.

Figure 8:
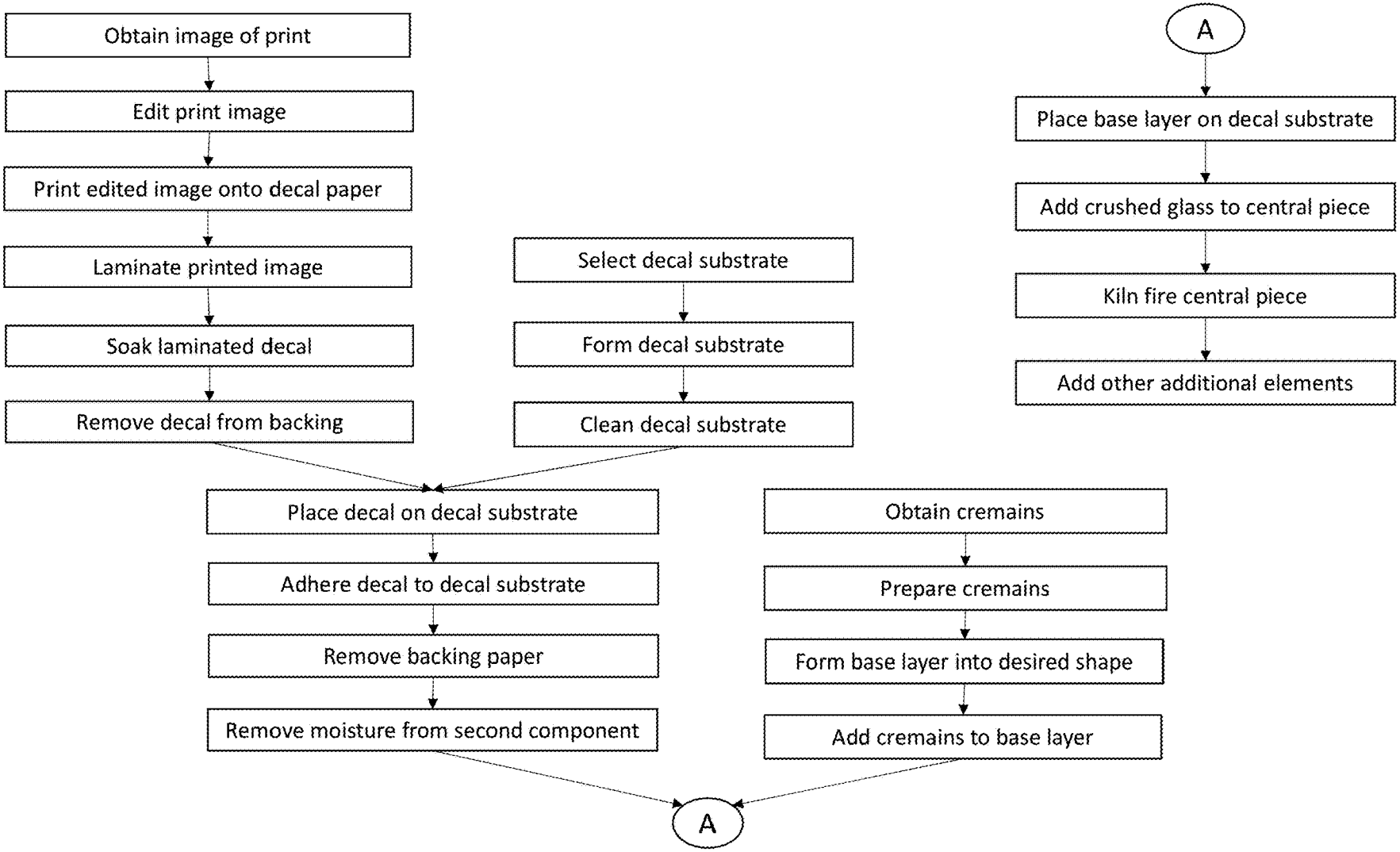
FIG. 8 is a flowchart with exemplary steps for forming the jewelry of FIG. 1.

FIG. 8 is a flowchart with exemplary steps for forming the jewelry 10. An image of the desired print, such as but not limited to a fingerprint, may be obtained. The image of the print may be of a deceased person or animal whose cremains 15 are placed into the jewelry 10, though such is not required. The image of the print is put on the glass with ceramic materials that are configured to withstand high temperatures, such as those experienced during kiln firing and which will result in an extremely durable image.

The desired substrate 19 may be selected. For example, without limitation, a particular shape, size, color, pattern, or the like substrate 19 may be selected according to customer preferences. Alternatively, or additionally, the substrate 19 may be formed into the desired size or shape. The substrate 19 may be cleaned.

The base layer 11 may be selected. For example, without limitation, a particular size, shape, color, pattern, or the like may be selected based on the customer's preferences. Alternatively, or in addition, the base layer 11 may be formed into the desired size and or shape.

The cremains 15 may be deposited on the base layer 11, though such is not required. For example, without limitation, the cremains 15 may be deposited as is shown in FIG. 5C. Where the first component 14 comprises an iridescent layer 13, the cremains 15 may be placed on the other side of the first component 14. In exemplary embodiments, the cremains 15 may be spread or moved to create gaps between the cremains 15. The cremains 15 may be arranged in a non-uniform pattern, though such is not required. Preferably, the cremains 15 are kept at least $1/8^{th}$ of an inch away from the edges of the base layer 11. Preferably, the cremains 15 are kept away from portions of the base layer 11 where the additional elements may be attached. For example, without limitation, the cremains 15 may be kept away from an upper portion of the base layer 11 where one or more holes may be drilled to accommodate the bale 22.

Figure 11:
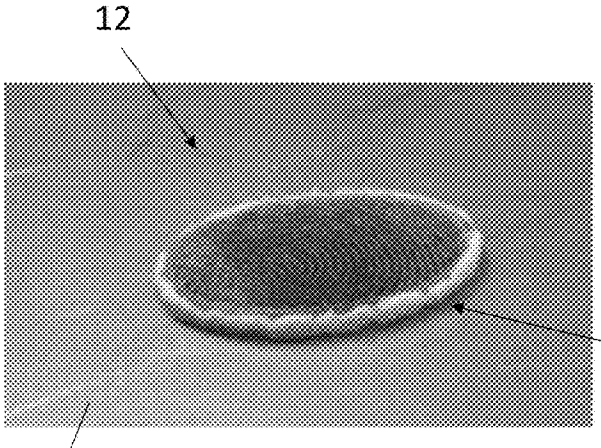
FIG. 11 is a top perspective view of a partially formed central piece of FIGS. 1-4 and 7.
Figure 10:
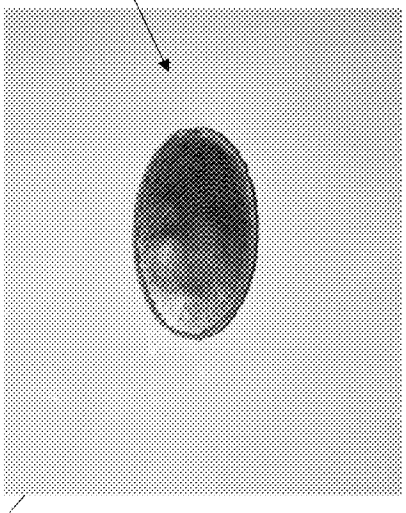
FIG. 10 is a top view of the second component of FIG. 6.
Figure 9:
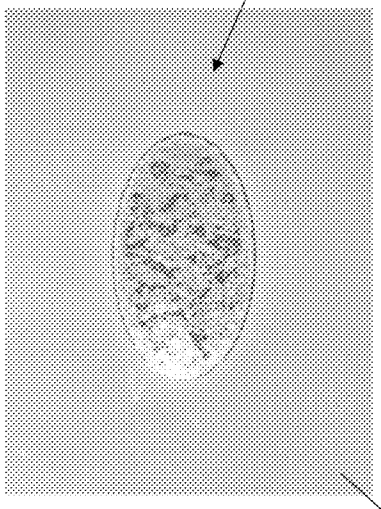
FIG. 9 is a top view of the first component of FIG. 5A through FIG. 5C.

As shown in FIG. 9 through FIG. 11, the first component 14 may be placed atop the second component 16. In exemplary embodiments, the base layer 11 may be positioned with the cremains 15 facing upward on a work surface 56 and the substrate 19 may be positioned atop the base layer 11 such that the image 17 comprising the image of the print faces upwards towards the front. The first and second components 14 and 16 may be checked for alignment using an illumination device, such as but not limited to, a flashlight.

The first and second components 14 and 16 may be joined together by an annealing process. In exemplary embodiments, the first and second components 14 and 16 are annealed by placing the central piece 12 into a kiln. Once removed from the kiln, the central piece 12 may be allowed to cool for a period of time. The central piece may be shaped, cleaned, and/or polished. Additional elements may be added to the base 14 including, but not limited to, the bale 22 and the necklace 20 to complete the jewelry 10. For example, without limitation, one or more holes may be drilled into the central piece 12, which the bale 22 may be passed through. For clarity, annealing may include one or more heating and cooling processes. The heating process(es) may include or more steps or stages. Likewise, the cooling process(es) may include one or more cooling steps or stages.

While some examples are provided herein with respect to a fingerprint, it is contemplated that the image may alternatively or additionally comprise a toe print, palm print, foot print, paw print, or the like. Any kind or type of image is contemplated.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An item of jewelry comprising:

a first component comprising:

a base layer comprising glass and having a first surface and a second surface; and cremains deposited on the first surface; and a second component of a matching size and shape as the first component, wherein an outer edge of the first component is aligned with an outer edge of the second component, said second component comprising:

a substrate comprising glass; and a printed image, wherein said printed image comprises one or more ceramic pigments, wherein the printed image is secured to the substrate, and the substrate is secured to the base layer such that the cremains are sandwiched between the base layer and the substrate;

wherein the first and second components form a unitary item.

2. The item of jewelry of claim 1 wherein:

said substrate comprises one or more colored pigments.

3. The item of jewelry of claim 1 wherein:

the printed image is of a fingerprint of a deceased person.

4. The item of jewelry of claim 3 wherein:

the cremains comprise human cremains of the deceased person.

5. The item of jewelry of claim 4 wherein:

the first and second components are shaped as an oval.

6. The item of jewelry of claim 4 further comprising:

a bale attached to an upper portion of the first and second components.

7. The item of jewelry of claim 6 further comprising:

a necklace or a bracelet secured to the first and second components by way of the bale such that the first and second components form a pendant.

8. The item of jewelry of claim 7 wherein:

the first and second components comprise a hole, wherein a first portion of the bale passes through the hole and a second portion of the bale is secured to the necklace or bracelet.

9. The item of jewelry of claim 7 wherein:

the second surface of the base layer comprises an iridescent material.

10. The item of jewelry of claim 1 wherein:

the cremains comprise animal cremains of a deceased animal; and the printed image is of a paw print of the deceased animal.

11. The item of jewelry of claim 1 wherein:

the first and second components are configured to be secured to one another by annealing to form the unitary item.

12. The item of jewelry of claim 1 wherein:

the printed image comprises a decal.

13. A method of forming an item of jewelry comprising the steps of:

obtaining an image of a fingerprint from a deceased individual;

printing the image;

placing the printed image onto a substrate, wherein said substrate comprises glass and one or more ceramic pigments, wherein each of said ceramic pigments comprises one or more colored pigments and glass;

obtaining cremains from the deceased individual;

preparing the cremains;

depositing the cremains on a surface of a base layer comprising glass;

positioning the substrate above the base layer such that the cremains are sandwiched between said substrate and said base layer and such that an outer edge of the substrate is aligned with an outer edge of the base layer; and annealing the base layer to the substrate.

14. The method of claim 13 wherein:

the cremains are deposited on the base layer in a non-uniform pattern such that the cremains are at least $1/8^{th}$ of an inch away from the outer edge of the base layer.

15. The method of claim 13 further comprising the steps of:

drilling a hole in an upper portion of the base layer and substrate;

attaching a bale through the hole; and attaching a necklace to the bale.

16. The method of claim 13 further comprising the steps of:

forming the substrate into a desired shape; and forming the base layer into a matching shape.

17. A method of forming an item of jewelry comprising the steps of:

obtaining an image of a fingerprint from a deceased individual;

printing the image in an oval shape using one or more ceramic pigments, wherein each of said ceramic pigments comprises one or more colored pigments, glass, alumina, silica, and flux;

securing the printed image to a substrate, wherein said substrate is shaped as an oval to match the printed image, and wherein said substrate comprises glass;

obtaining cremains of the deceased individual;

depositing the cremains on a surface of a base layer such that the cremains are distributed in a non-uniform pattern and are located at least $1/8^{th}$ of an inch away from an outer edge of the base layer;

positioning the substrate above the base layer such that the cremains are sandwiched between said substrate and said base layer and such that an outer edge of the substrate is aligned with the outer edge of the base layer; and annealing the base layer to the substrate such that the printed image in encased in glass.

18. The method of claim 17 further comprising the steps of:

placing the substrate and base layer in a kiln;

heating the kiln to anneal the base layer to the substrate, and then allowing the kiln to cool to room temperature;

removing the annealed base layer and substrate;

drilling a hole in an upper portion of the annealed base layer and substrate;

attaching a bale through the hole; and attaching a necklace to the bale.

19. The method of claim 17 wherein:

the step of securing the printed image to the substrate comprises the sub-steps of:

printing the image onto decal paper;

removing a portion of the decal paper comprising the printed image from a backing; and applying the portion of the decal paper comprising the printed image to the substrate.

20. The method of claim 19 further comprising the steps of:

editing the image.

* * * * *